US009342036B2

(12) United States Patent
Souda

(10) Patent No.: US 9,342,036 B2
(45) **Date of Patent: *May 17, 2016**

(54) IMAGE FORMING APPARATUS WITH A PAIR OF RESIN AND METAL FRAMES

(71) Applicant: Brother Kogyo Kabushiki Kaisha, Nagoya (JP)

(72) Inventor: Makoto Souda, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/632,067

(22) Filed: Feb. 26, 2015

(65) Prior Publication Data

US 2015/0261174 A1 Sep. 17, 2015

(30) Foreign Application Priority Data

Mar. 11, 2014 (JP) ..... 2014-047273

(51) Int. Cl.
*G03G 21/16* (2006.01)
*G03G 15/00* (2006.01)

(52) U.S. Cl.
CPC ..... *G03G 21/1619* (2013.01); *G03G 15/757* (2013.01); *G03G 2221/1678* (2013.01); *G03G 2221/1684* (2013.01)

(58) Field of Classification Search
CPC ..... G03G 21/1619
USPC ..... 399/64
See application file for complete search history.

(56) References Cited

U.S. PATENT DOCUMENTS

| | | | | |
|---|---|---|---|---|
| 6,778,197 | B2 * | 8/2004 | Yamanaka | 347/129 |
| 7,522,858 | B2 * | 4/2009 | Okabe et al. | 399/110 |
| 7,835,663 | B2 * | 11/2010 | Tomatsu | 399/107 |
| 7,873,294 | B2 * | 1/2011 | Nobe et al. | 399/88 |
| 8,175,491 | B2 * | 5/2012 | Tomatsu et al. | 399/107 |
| 9,052,674 | B2 * | 6/2015 | Souda | 1/1 |
| 2003/0103780 | A1 | 6/2003 | Hoashi | |
| 2006/0029422 | A1 * | 2/2006 | Shiraki | 399/111 |
| 2009/0317126 | A1 | 12/2009 | Tomatsu | |
| 2011/0065336 | A1 * | 3/2011 | Souda | 439/824 |
| 2011/0116830 | A1 | 5/2011 | Matsui et al. | |
| 2011/0123246 | A1 | 5/2011 | Ando et al. | |
| 2011/0280614 | A1 | 11/2011 | Yamauchi et al. | |
| 2014/0086614 | A1 | 3/2014 | Souda | |

FOREIGN PATENT DOCUMENTS

| | | | |
|---|---|---|---|
| JP | 2003-107822 | A | 4/2003 |
| JP | 2003-167411 | A | 6/2003 |
| JP | 2004-045923 | A | 2/2004 |

(Continued)

*Primary Examiner* — Clayton E Laballe
*Assistant Examiner* — Leon W Rhodes, Jr.
(74) *Attorney, Agent, or Firm* — Burr & Brown, PLLC

(57) ABSTRACT

An image forming apparatus, including a main body and a driving force transmission, is provided. The main body supports an image forming unit which includes an image carrier. The driving force transmission transmits a driving force to the image carrier. The main body includes a first frame, a second frame, and a connecting member. The first frame is made of resin, disposed on one side of the image carrier with regard to a direction of rotation axis of the image carrier, and supports the driving force transmission disposed thereon. The second frame is made of metal and disposed on the other side of the image carrier with regard to the direction of rotation axis. The connecting member connects the first frame and the second frame with each other.

16 Claims, 8 Drawing Sheets

(56) References Cited

FOREIGN PATENT DOCUMENTS

| | | | | |
|---|---|---|---|---|
| JP | 2005037652 | A | * | 2/2005 |
| JP | 2010-002626 | A | | 1/2010 |
| JP | 2011-107557 | A | | 6/2011 |
| JP | 2011-145357 | A | | 7/2011 |
| JP | 2011-237641 | A | | 11/2011 |
| JP | 2014-063002 | A | | 4/2014 |

* cited by examiner

IMAGE FORMING APPARATUS WITH A PAIR OF RESIN AND METAL FRAMES

CROSS REFERENCE TO RELATED APPLICATION

This application claims priority from Japanese Patent Application No. 2014-047273 filed on Mar. 11, 2014, the entire subject matter of which is incorporated herein by reference.

BACKGROUND

1. Technical Field

An aspect of the present invention relates to an image forming apparatus having a body which supports an image forming unit including an image carrier.

2. Related Art

An image forming apparatus such as a laser printer may have a body to support an image forming unit which includes a photosensitive drum. The body may have a body frame formed to have an approximate shape of a box to accommodate the image forming unit. The body frame may include a pair of metal-plate frames to support the image forming unit and a pair of resin frames to support bottoms of the metal-plate frames from below.

SUMMARY

The pair of metal-plate frames in the body of the conventional image forming apparatus to support the image forming unit laterally may be in a substantial size to cover lateral faces of the image forming unit. Therefore, due to the substantial size of the metal-plate frames, an entire weight of the body of the image forming unit may be undesirably increased.

The present invention is advantageous in that an image forming apparatus, of which weight may be reduced, is provided.

According to an aspect of the present invention, an image forming apparatus, including a main body and a driving force transmission, is provided. The main body supports an image forming unit which includes an image carrier. The driving force transmission transmits a driving force to the image carrier. The main body includes a first frame, a second frame, and a connecting member. The first frame is made of resin, disposed on one side of the image carrier with regard to a direction of rotation axis of the image carrier, and is configured to support the driving force transmission disposed thereon. The second frame is made of metal and disposed on the other side of the image carrier with regard to the direction of rotation axis. The connecting member connects the first frame and the second frame with each other.

BRIEF DESCRIPTION OF THE ACCOMPANYING DRAWINGS

DETAILED DESCRIPTION

Hereinafter, an exemplary configuration of a color laser printer 1 according to an embodiment of the present invention will be described with reference to the accompanying drawings. First, an overall configuration of the color laser printer 1 will be described, and second, specific components in the color laser printer 1 will be described in detail.

Figure 1:
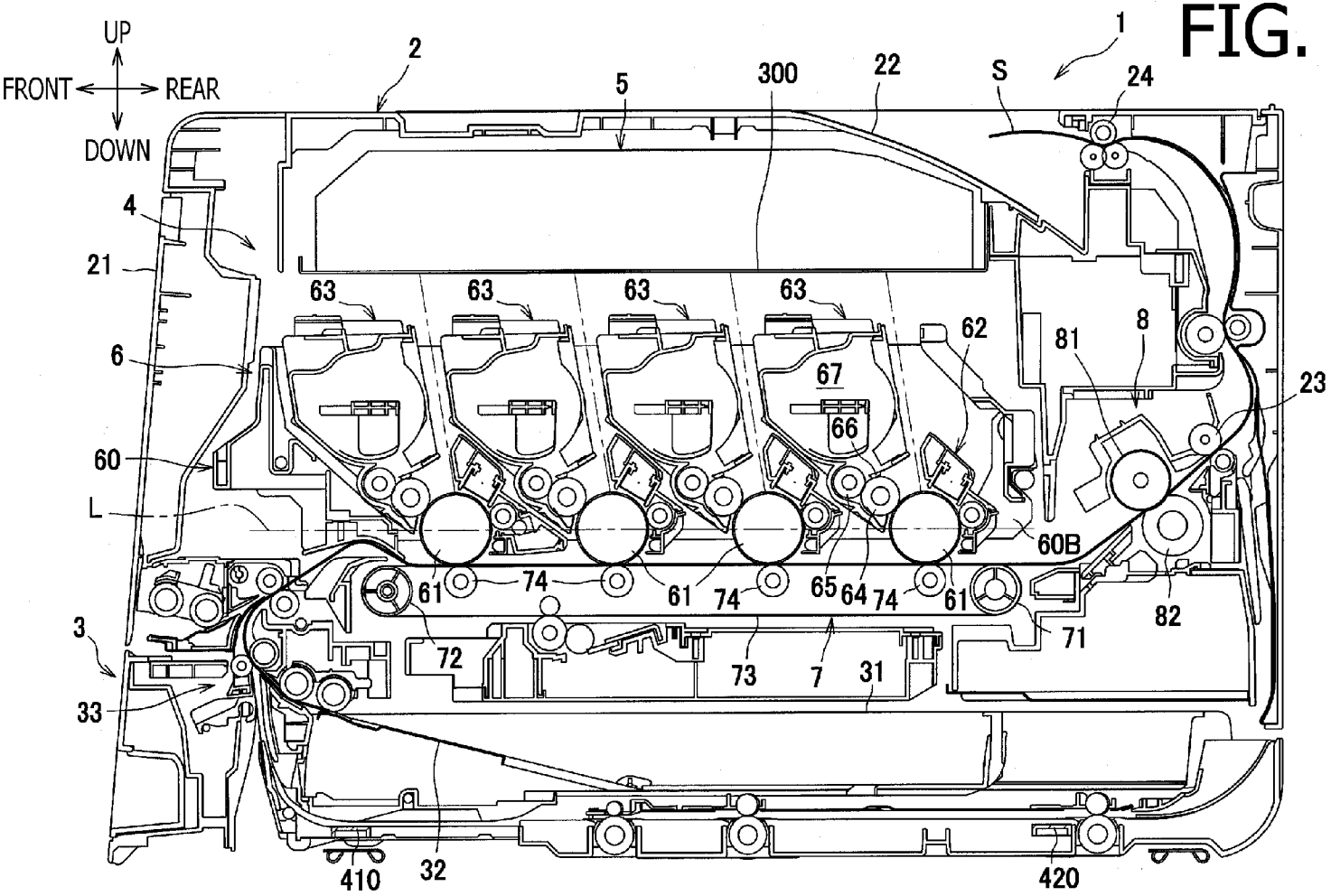
FIG. 1 is a cross-sectional side view of a color laser printer according to an embodiment of the present invention.
Figure 2:
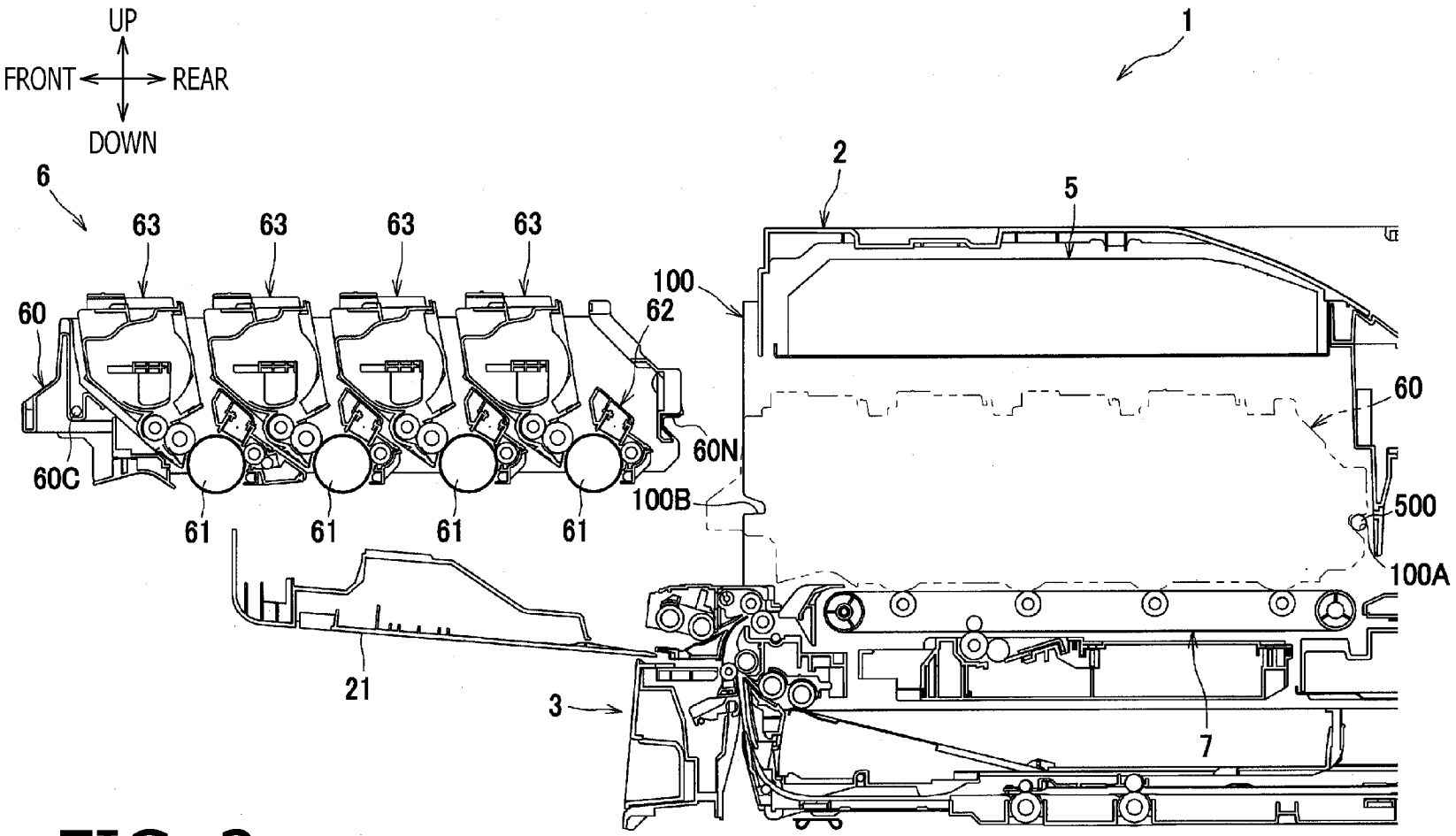
FIG. 2 is a cross-sectional side view of the color laser printer with a processing unit being drawn out of a main body of the color laser printer according to the embodiment of the present invention.

In the following description, directions concerning the color laser printer 1 will be referred to in accordance with orientation indicated by arrows in each drawing. Therefore, for example, a viewer's left-hand side appearing in FIG. 1 is referred to as a front side of the color laser printer 1, and a right-hand side in FIG. 1 opposite from the front side is referred to as a rear side. A side which corresponds to the viewer's nearer side is referred to as a right-hand for a user, and an opposite side from the right, which corresponds to the viewer's farther side is referred to as a left-hand side for the user. An up-down direction in FIG. 1 corresponds to a vertical direction of the color laser printer 1. Further, the right-to-left or left-to-right direction of the color laser printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-8 are similarly based on the orientation of the color laser printer 1 as defined above and correspond to those with respect to the color laser printer 1 shown in FIG. 1 even when the drawings are viewed from different angles.

Overall Configuration of the Color Laser Printer

The color laser printer 1 includes a feeder unit 3 and an image forming unit 4, which are arranged inside a main body 2. The feeder unit 3 is configured to feed sheets S to the image forming unit 4, and the image forming unit 4 is configured to form an image on the sheet S being fed. The image forming unit 4 includes an exposure device 5, a processing unit 6, a transfer unit 7, and a fixing unit 8.

The feeder unit 3 is disposed in a lower position in the main body 2 and includes a feeder tray 31, a sheet-pressing plate 32, and a feeder system 33. The feeder tray 31 accommodates a sheet S to be fed to the processing unit 6 of the image forming unit 4 and is detachably attached to the main body 2. The feeder tray 31 is, when attached to the main body 2, located in a lower position with respect to the processing unit 6. The sheets S in the feeder tray 31 are pressed by the sheet-pressing plate 32 upward so that front ends of the sheets S are uplifted to be picked up by the feeder system 33 and separated one-by-one to be fed to the image forming unit 4.

The exposure device 5 is disposed in an upper position in the main body 2 and includes a plurality of laser light sources (unsigned), polygon mirrors (unsigned), lenses (unsigned), and reflection mirrors (unsigned). Laser beams emitted from the laser light sources for a plurality of (e.g., four) colors are reflected on the polygon mirrors and the reflection mirrors and transmit through the lenses to be casted, as indicated by dash-and-dot lines in FIG. 1, to scan on surfaces of photosensitive drums 61 in the processing unit 6.

The processing unit 6 is disposed between the feeder tray 31 and the exposure device 5 and includes a holder 60, a plurality of (e.g., four) photosensitive drums 61, chargers 62, and developer cartridges 63. The photosensitive drums 61 are arranged longitudinally along a predetermined direction, e.g., the front-rear direction and are configured to carry images on surfaces thereof. Each of the chargers 62 and each of the developer cartridges 63 are provided to correspond to one the photosensitive drums 61. Each developer cartridge 63 includes a developer roller 64, a supplier roller 65, a spreader blade 66, and a toner container 67 to contain a toner.

The holder 60 supports the plurality of photosensitive drums 61 and is movable along the front-rear direction with respect to the main body 2. Therefore, the holder 60, including the processing unit 6, can be drawn out of the main body 2 of the color laser printer 1 through an opening (unsigned), which is exposed when a front cover 21 on the front side of the main body 2 is opened, from an attached position indicated in FIG. 2 by broken lines to a removed position, which is for example indicated by solid lines. The developer cartridges 63 are removably supported by the holder 60 and are exchangeable when the processing unit 6 is in the removed position.

Referring back to FIG. 1, the transfer unit 7 is disposed in a position between the feeder unit 31 and the processing unit 6. The transfer unit 7 includes a driving roller 71, a driven roller 72, a conveyer belt 73, and a plurality of (e.g., four) transfer rollers 74. The conveyer belt 43 is an endless belt strained around the driving roller 71 and the driven roller 72. The conveyer belt 73 is arranged to have an upper outer surface thereof to be in contact with the photosensitive drums 61. The transfer rollers 74 are arranged in positions opposite from the photosensitive drums 61 across the conveyer belt 73, i.e., an inner side of the transfer rollers 74. Therefore, the conveyer belt 73 is disposed between the transfer rollers 74 and the photosensitive drums 61 and contacts the transfer rollers 74 at an upper inner surface thereof The fixing unit 8 is disposed in a rearward position with respect to the processing units 6 and the transfer unit 7 and includes a heat roller 81 and a pressure roller 82. The pressure roller 82 is disposed in a position to face with the heat roller 81 and is urged against the heat roller 81.

In the image forming unit 4, during an image forming operation, surfaces of the photosensitive drums 61 are electrically charged by the corresponding chargers 62 evenly and exposed to the laser beams emitted from the exposure device 5 so that electrical charges of the exposed areas are removed and latent images according to image data are formed to be carried on the surfaces of the photosensitive drums 61. Meanwhile, the toners in the toner containers 67 are supplied to the developer rollers 64 through the supplier rollers 65 and enter intermediate positions between the developer rollers 64 and the spreader blades 66 to be applied to the surfaces of the developer rollers 64 to form layers in a predetermined thickness. Thus, the layers of the toners are carried on the surfaces of the developer rollers 64.

The toners on the surfaces of the developer rollers 64 are supplied to the latent images being carried on the corresponding photosensitive drums 61. Thus, the latent images are developed to form toner images to be carried on the photosensitive drums 61. Thereafter, as the sheet S conveyed by the feeder unit 3 passes through the positions between the photosensitive drums 61 and the conveyer belt 73, the toner images formed on the photosensitive drums 61 are transferred onto the sheet S in colored layers.

As the sheet S with the transferred toner images is conveyed through an intermediate position between the heat roller 81 and the pressure roller 82, the toner images are thermally fixed on the sheet S. The sheet S with the thermally fixed toner images is ejected out of the main body 2 by a conveyer roller 23 and an ejection roller 24 and placed on an ejection tray 22.

Configuration of the Main Body of the Color Laser Printer

Figure 3:
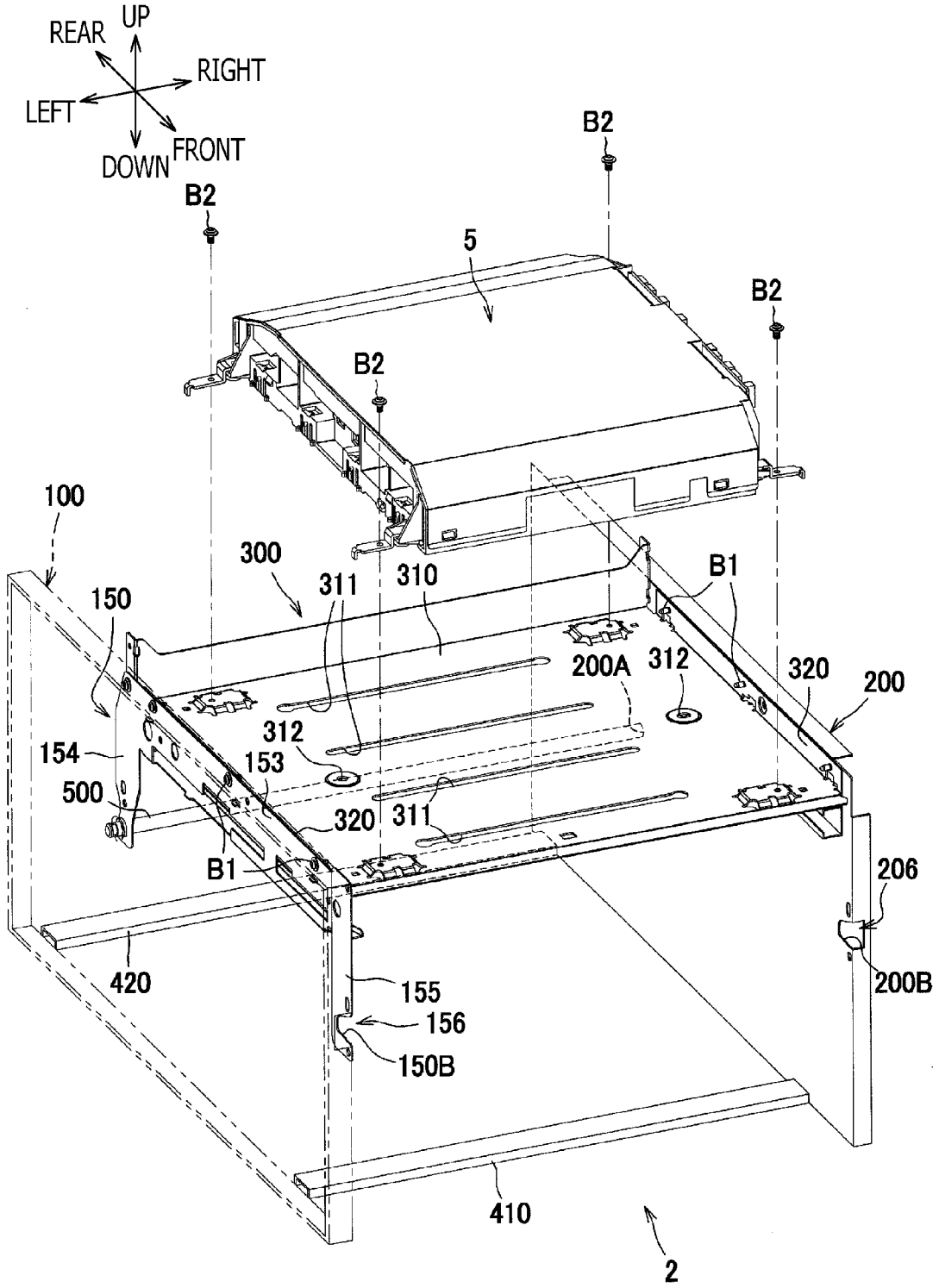
FIG. 3 is an exploded view of the main body and an exposure device of the color laser printer.

Next, detailed configuration of the main body 2 will be described. As shown in FIG. 3, the main body 2 includes a frame assembly, which includes a first frame 100, a second frame 200, a scanner plate 300, a front beam 410, and a rear beam 420. The main body 2 further includes an exterior cover (not shown), which forms an exterior casing of the color laser printer 1.

The first frame 100 is made of insulating resin such as acrylonitrile butadiene styrene (ABS) and formed in, for example, molding. The first frame 100 is disposed on a leftward side of the photosensitive drums 61, which is one of sides of the photosensitive drums 61 with regard to a direction of rotation axes of the photosensitive drums 61. On the first frame 100, disposed is a driving force transmission 110, which transmits a driving force to movable devices in the processing unit 6, e.g., the photosensitive drums 61 and the developer cartridges 63. Further, a controller board 120 and a sensor 130 are disposed on the first frame 100.

Figure 4:
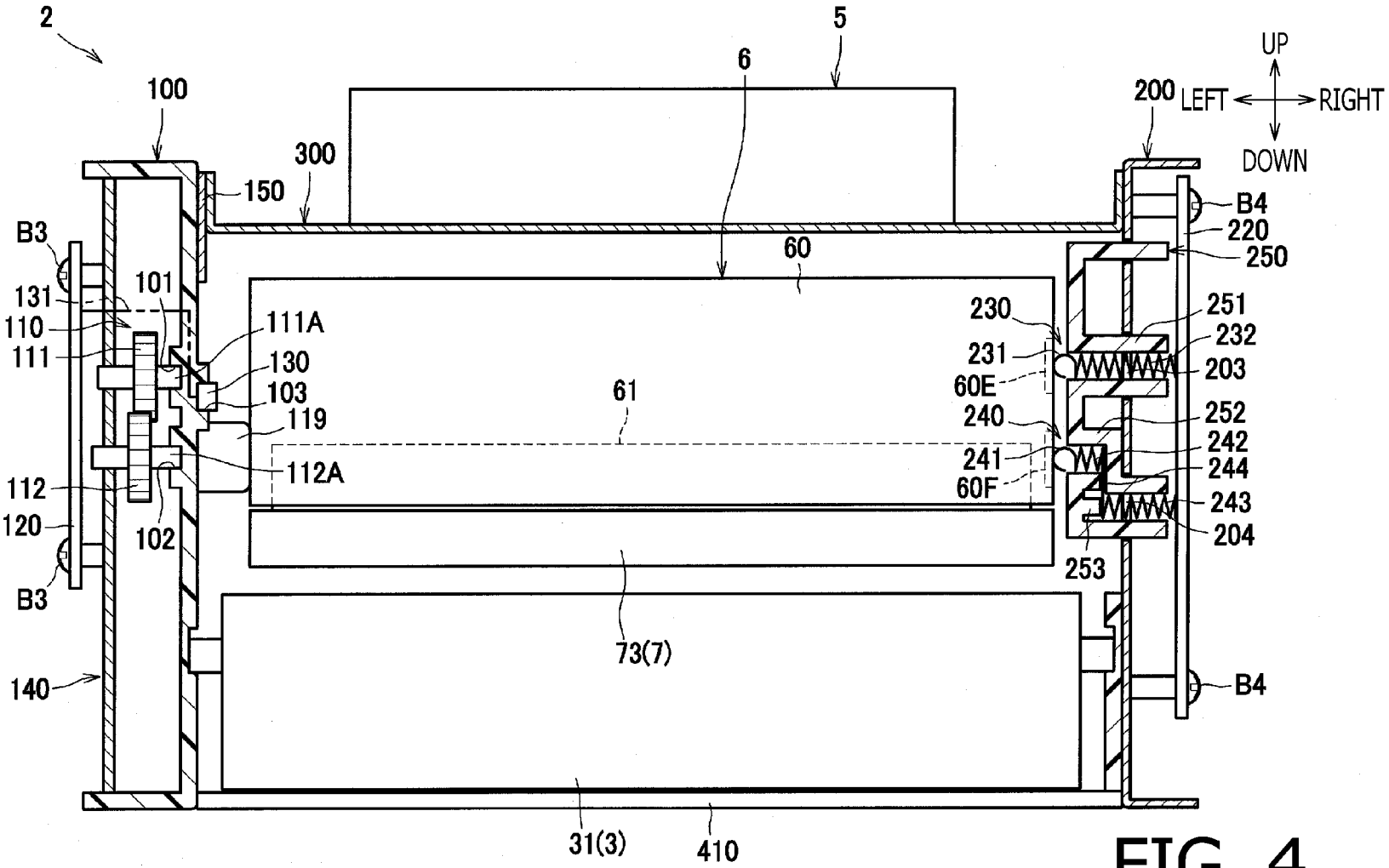
FIG. 4 is a cross-sectional view of the main body of the color laser printer.

The driving force transmission 110 includes a plurality of gears, which transmit the driving force from a motor (not shown) to the processing unit 6, and a known coupling 119, which inputs the driving force from a gear train including the plurality of gears to the processing unit 6. In FIG. 4, two (2) gears 111, 112 representing the plurality of gears are shown. Arrangement of the plurality of gears in the driving force transmission 110 and a method to transmit the driving force from the gear train to the coupling 119 may be those that are widely known; therefore, explanation of those is herein omitted.

The gears 111, 112 are made of resin and include gear shafts 111A, 112, which protrude sideward along the widthwise direction from disc-shaped main parts (unsigned) respectively. Meanwhile, the first frame 100 has a plurality of gear supports (unsigned), which support the plurality of gears in the driving force transmission 110 respectively rotatably. In FIG. 4, two (2) gear supports 101, 102 representing the plurality of gear supports are shown. The gear supports 101, 102 are formed to dent sideward to be engaged with rightward ends of the gear shafts 111A, 112A. On the other hand, leftward ends of the gear shafts 111A, 112A are rotatably supported by a board-attachable member 140, which is fixed to the first frame 100.

The sensor 130 is usable to control behaviors of the color laser printer 1. The sensor 130 may include, for example, a toner run-out sensor, a cover-open sensor, a temperature sensor, and a humidity sensor. The toner run-out sensor may detect light emitted toward the toner container 67 and transmitting through the toner container 67 to determine emptiness of the toner container 67 so that a timing to exchange the developer cartridges 63 is noted. The cover-open sensor may detect the front cover 21 being open or closed. The temperature sensor and the humidity sensor may detect temperature and humidity of atmosphere inside the main body 2 respectively. The first frame 100 includes a sensor support 103 to support the sensor 130. The sensor support 103 is formed to dent to fit with the sensor 130. In FIG. 4, one (1) sensor 130 and one (1) sensor support 103 are shown; however, the sensor 130 and the sensor support 103 may include a plurality of sensors 130 and a plurality of sensor supports 103, which are not shown, respectively.

A controller board 120 includes a circuit board to control behaviors of the components in the color laser printer 1. The controller board 120 is fixed to the board-attachable member 140 by screws B3 so that the controller board 120 is fixed to the first frame 100 through the board-attachable member 140. The controller board 120 is connected with the sensor 130 through a harness 131.

The second frame 200 is made of a metal plate, which is for example galvanized steel plate being bent at several parts. The second frame 200 is disposed on a rightward side of the photosensitive drums 61, which is the other side of the photosensitive drums 61 from the first frame 200 with regard to the direction of rotation axes. In other words, the second frame 200 is arranged to face with the first frame 100 along the direction of rotation axes. In the present embodiment, the second frame 200 and the first frame 100 are formed in sizes having substantial outlines, which encompass the feeder unit 3 and the processing unit 6 therein in a view along the widthwise direction, i.e., the direction of rotation axes of the photosensitive drums 61. In this regard, the first and second frames 100, 200 are the largest members among other members which form laterals of the color laser printer 1.

On the second frame 200, disposed are a power board 220 and a plurality of spring electrodes 230, 240. The second frame 200 includes through-holes 203, 204, which are bored through the second frame 200 along the widthwise direction, so that the spring electrodes 203, 204 are disposed in the through-holes 203, 204 to penetrate through the second frame 200. Further, electrode protectors 250, which are made of insulating resin such as ABS, to insulate the spring electrodes 230, 240 from the metal-made second frame 200 are disposed on the second frame 200.

The power board 220 includes a circuit board to supply electricity to the processing unit 6. For example, the power board 220 may apply a predetermined intensity of electrical bias to the chargers 62 and the developer rollers 64. The power board 220 is disposed on an opposite side from the processing unit 6 across the second frame 200, i.e., a rightward side of the second frame 200, and is fixed to the second frame 200 by screws B4.

The spring electrodes 230, 240 include electrodes to electrically connect the chargers 6 and the developer rollers 64 respectively in the processing unit 6 with the power board 220. In FIG. 4, one (1) set of electrode 230, electrode 240, through-hole 203, and through-hole 204 is shown; however, each of the four chargers 62 and developer rollers 64 is provided with the set of electrode 230, electrode 240, through-hole 203, and through-hole 204. In other words, four (4) sets of electrode 230, electrode 240, through-hole 203, and through-hole 204 are arranged on the second frame 200.

The spring electrode 230 may be a piece of metal wire and includes a ring part 231 at one end and a resiliently coiled spring part 232 on the other end, which are formed integrally. The spring electrode 230 is arranged in the through-hole 203 in the second frame 200, and inside an electrode support 251, which is formed in a cylindrical shape in the electrode protector 250. A leftward end of the ring part 231 protrudes from a leftward face of the electrode protector 250, while a rightward end of the spring part 232 is electrically connected to the power board 220.

The spring electrode 240 may be a piece of metal wire and includes a ring part 241, a first spring part 242, a second spring part 243, and a conducting part 244, which are formed integrally. The ring part 241 is formed at one end of the spring electrode 240. The first spring part 242 and the second spring part 243 are resiliently coiled springs. The first spring part 242 and the second spring part 243 are arranged in positions vertically displaced from each other in a view along the widthwise direction, and the conducting part 244 is conductive between the first spring part 242 and the second spring part 243.

The spring electrode 240 is arranged in the through-hole 204 in the second frame 200, and inside an electrode support 252, which is formed to bend in zigzag in the electrode protector 250. A leftward end of the ring part 241 protrudes from the leftward face of the electrode protector 250, while a rightward end of the second spring part 243 is electrically connected to the power board 220. The second spring part 243 is arranged in the electrode support 252 in a compressed condition between a projection 253 formed in the electrode support 252 and the power board 220. Thus, the spring electrode 240 is urged against the power board 220 so that the electrical connection between the spring electrode 240 and the power board 220 may be securely maintained.

Meanwhile, on a rightward face of the holder 60, arranged are holder electrodes 60E, 60F. The holder electrodes 60E, 60F are electrically connected with the charger 62 and the developer roller 64 respectively and are exposed outward in a leftward view from the right-hand side.

When the holder 60 with the processing unit 6 is attached to the main body 2, the holder electrode 60E and the holder electrode 60F contact the ring part 231 of the spring electrode 230 and the ring part 241 of the spring electrode 240 respectively. Thereby, the processing unit 6 is electrically connected with the power board 220 through the spring electrodes 203, 240, and the electrical bias from the power board 220 may be applied to the chargers 62 and the developer rollers 64.

When the processing unit 6 is attached to the main body 2, with the spring part 232 being compressed, the spring electrode 230 is placed in the compressed condition between the processing unit 6 and the power board 220. Similarly, with the first spring part 242 being compressed, the spring electrode 240 is placed in the compressed condition between the processing unit 6 and the second frame 200, through the electrode protector 250. Thus, the ring parts 231, 241 are urged against the holder electrodes 60E, 60F respectively, and the electrical connection between the holder electrodes 60E, 60F and the power board 220 may be securely maintained.

Figure 5:
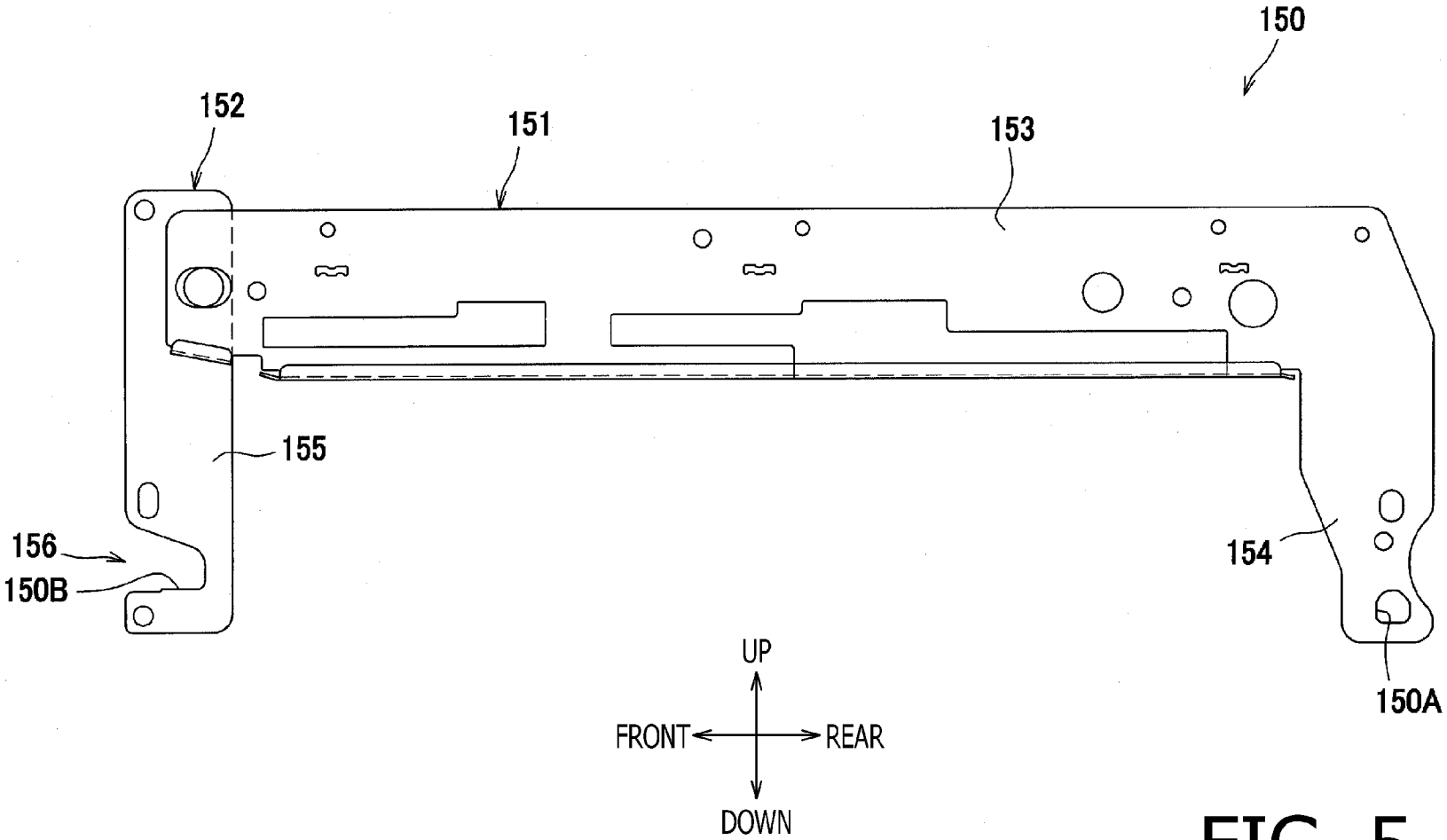
FIG. 5 is a lateral view of a metal frame.

As shown in FIG. 3, on the rightward face of the first frame 100, which is the side of the photosensitive drums 61 (see also FIG. 4), a metal frame 150 is fixed to the first frame 100. The metal frame 150 is a plate of metal such as galvanized steel. As shown in FIG. 5, the metal frame 150 includes a first metal frame 151, which is formed in an approximate shape of an L, and a second metal frame 152, which is formed in an approximate shape of an I. The first metal frame 151 and the second metal frame 152 are in an arrangement such that a front part of the first metal frame 151 overlaps an upper part of the second metal frame 152 while the first metal frame 151 is on the right and the second metal frame is on the left. The metal frame 150 configured as above is fixed to an inner surface of the frame 100, which is not shown in FIG. 5.

The metal frame 150 includes a main part 153 and a pair of extended parts 154, 155. The main part 153 is elongated along the front-rear direction and includes an upper part of the first metal frame 151 and an upper part of the second metal frame 152. The extended parts 154, 155 extend from a front end and a rear end of the main part 153 downward. The main part 153 includes screw holes (unsigned), through which the metal frame 150 is fixed to the first frame by screws (not shown), and screw holes (unsigned), through which the scanner plate 300 is fixed to the metal frame 150 by screws (not shown).

Figure 6:
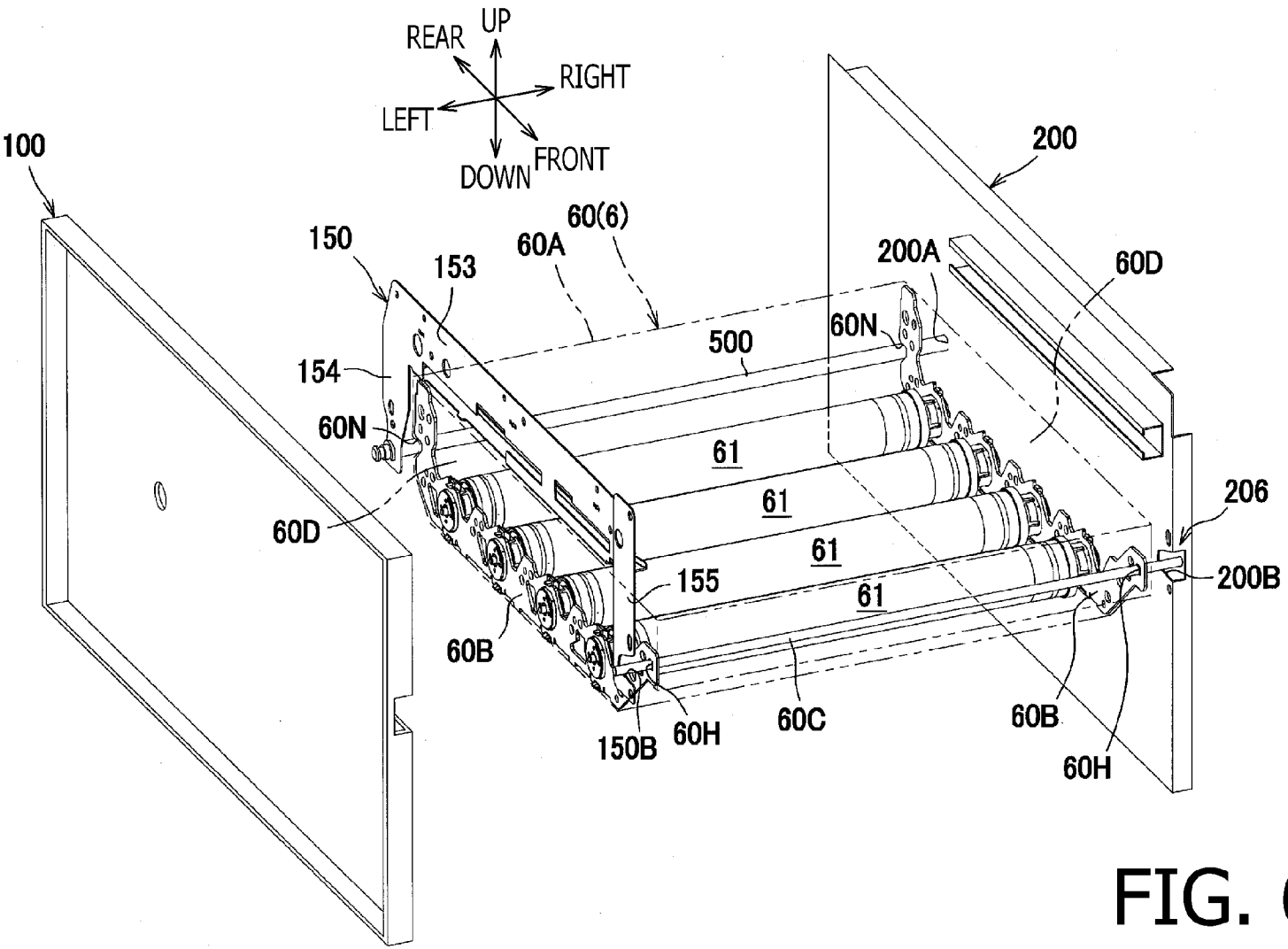
FIG. 6 is a perspective view of a frame assembly including a first frame, the metal frame, and a second frame along with the processing unit in the color laser printer.

As shown in FIGS. 5 and 6, the metal frame 150 and the second frame 200 are formed to have a positioning hole 150A, a positioning edge 150B; and a positioning hole 200A, a positioning edge 200B, respectively. The positioning holes 150A, 200A, and the positioning edges 150B, 200B serve to locate the holder 60 being attached to the main body 2 in a correct position.

The positioning hole 150A (see FIG. 5) is a through-hole formed in a lower position in the extended part 154 on the rear, while the positioning hole 200A is a through-hole formed in the second frame 200. The positioning holes 150A, 200A are arranged in a same position with regard to the front-rear direction and the vertical direction to align along the widthwise direction, and a metal-made shaft 500 is arranged to penetrate through the positioning holes 150A, 200A at both ends thereof. Thus, the shaft 500 is fixed to the metal frame 150 and the second frame 200 at the both ends thereof and longitudinally extends substantially along a horizontal direction.

The positioning edge 150B is a lower edge of a frontward-open dent 156, which is formed in a lower-front end of the extended part 155 of the metal frame 150. The positioning edge 200B is a lower edge of a frontward-open dent 206, which is formed on a front end of the second frame 200. The positioning edges 150B, 200B are arranged in a same position with regard to the front-rear direction and the vertical direction to align along the widthwise direction, substantially along the horizontal direction.

Below is described a configuration of the holder 60, which can be placed in the correct position through the positioning holes 150A, 200A and the positioning edges 150B, 200B.

As shown in FIG. 6, the holder 60 includes a holder frame 60A, a pair of lateral plates 60B, and a positioning shaft 60C. The holder frame 60A is a resin-made framework having a shape of a box, which is open at a top and a bottom, as indicated by dash-and-double-dot lines in FIG. 6. The pair of lateral plates 60B are arranged on widthwise ends of the four photosensitive drums 4. The positioning shaft 60C is a rod elongated along the widthwise direction.

Each of the lateral plates 60B is a metal plate, which is for example made of galvanized steel, and is fixed to an inner surface of each lateral face 60D of the holder frame 60A. The lateral plates 60B hold widthwise ends of the photosensitive drums 61 so that the photosensitive drums 61 are held spaced apart from one another at a predetermined interval along an aligning direction, which is the front-rear direction. In other words, the lateral plates 60B locate the positions of the photosensitive drums 61 with regard to the front-rear direction. Each lateral plate 60B is formed to have a rearward-open cutout 60N at a rear end thereof. The positioning shaft 60C is arranged to penetrate through the lateral plates 60B and the lateral faces 60D to protrude outward along the widthwise direction from front parts of the lateral faces 60D. The positioning shaft 60C is engaged with through-holes 60H, which are formed at front ends of the lateral plates 60B. Thus, the positioning shaft 60C is placed in the fixed position with regard to the paired lateral plates 60B.

Figure 7A:
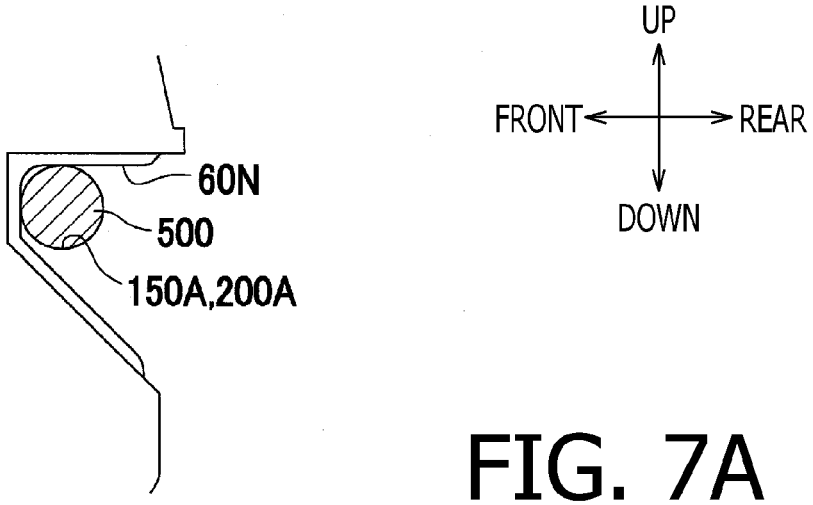
FIG. 7A is an illustrative view of a cutout of the holder engaged with a shaft in the color laser printer.
Figure 7B:
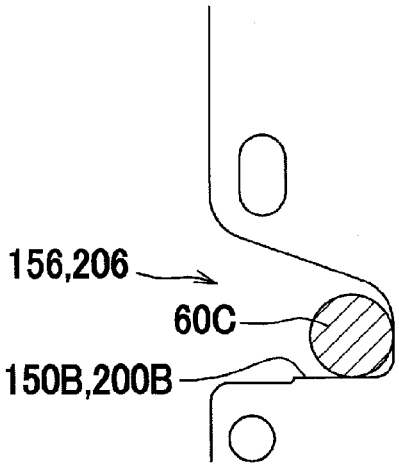
FIG. 7B is an illustrative view of a positioning shaft in the holder being in contact with a positioning surface in the printer.

When the holder 60 is attached to the main body 2, the shaft 500 engages with the cutouts 60N, as shown in FIG. 7A, while, as shown in FIG. 7B, the positioning shaft 60C contacts the positioning edges 150B, 200B from above. Thus, as shown in FIG. 6, the holder 60, i.e., the processing unit 6, is supported by the first frame 100 with the metal frame 150 being fixed and by the second frame 200. In this regard, the photosensitive drums 61 are supported by the first frame 100 and the second frame 200 through the holder 60.

As shown in FIG. 3, the scanner plate 300, the front beam 410, and the rear beam 420 connect the first frame 100 and the second frame 200 with each other. The scanner plate 300, the front beam 410, and the rear beam 420 are plates of galvanized steel which are bent at several parts. For example, the scanner plate 300 connects an upper part of the first frame 100 with an upper part of the second frame 200 through the metal frame 150. The front beam 410 connects a lower-front part of the first frame 100 with a lower-front part of the second frame 200, while the rear beam 420 connects a lower-rear part of the first frame 100 and a lower-rear part of the second frame 200. Thus, in a view along the widthwise direction, as shown in FIG. 1, the scanner plate 300 is arranged in an opposite position from the front beam 410 and the rear beam 420 across a line L, which extends through the rotation axes of the photosensitive drums 61, to locate the processing unit 6 in an intervening position between the scanner plate 300 and the front and rear beams 410, 420.

Referring back to FIG. 3, the scanner plate 300 includes a spread part 310 and a pair of fixing parts 320. The spread part 310 spreads between the first frame 100 and the second frame 200. The fixing parts 320 are formed to extend upward from widthwise ends of the spread part 310 and are fixed to the meal frame 150 and the second frame 200 by screws B2. The spread part 310 includes a plurality of (e.g., four) openings 311 and a pair of positioning holes 312. The openings 311 are slits elongated along the widthwise direction to allow the laser beams from the exposure device 5 to pass there-through. The positioning holes 312 are round openings, with which positioning bosses (not shown) formed on a bottom of the exposure device 5 are engaged.

The exposure device 5 can be placed in a correct position with respect to the main body 2 by placing the positioning bosses at the bottom to be engaged with the positioning holes 312 in the spread part 310 and is fixed to an upper surface of the spread part 310 by the screws B2. Thus, the exposure device 5 is supported by the metal frame 150 and the second frame 200 through the scanner plate 300.

The front beam 410 and the rear beam 420 are formed to have an approximate cross-sectional shape of a U. The front beam 410 and the rear beam 420 are fixed to the first frame 100 and the second frame 200 by, for example, screws and/or welding, which are not shown.

Next, usability of the color laser printer 1 configured as above is described below.

According to the color laser printer 1, the color laser printer 1 is equipped with the first frame 100 made of resin and the second frame 200 made of metal. Therefore, compared to a frame assembly having first and second frames both made of metal, a weight of the color laser printer 1 may be reduced.

According to the color laser printer 1, the power board 220 is fixed to the metal-made second frame 200; therefore, load from the spring electrodes 230, 240 in the compressed condition to the second frame 200 may be borne by the metal-made second frame 200, which is more rigid than a resin frame, securely. Further, the second frame 200 with the rigidity may be more difficult to be deformed against the load from the spring electrodes 230, 240; therefore, the second frame 200 may be formed to be thinner than the resin frame. Thus, the weight of the color laser printer 1 may be reduced more effectively.

According to the color laser printer 1, the gear supports 101, 102 and the sensor support 103 are formed in the resin-made first frame 100. Therefore, the gear supports 101, 102 and the sensor support 103 may be formed integrally in a less complicated manufacturing process, in more flexibly designed shapes. In other words, a range of design options for the color laser printer 1 may be widened.

According to the color laser printer 1, the controller board 120 and the sensor 130 are arranged on the first frame 100; therefore, a length of the harness 131 to connect the controller board 120 with the sensor 130 may be shortened, and a pathway for the harness 130 may be reserved easily, compared to a configuration, in which the controller board 120 and the sensor 130 are arranged on different frames. In this regard, a frame of a metal plate may be more difficult for being formed in a complex shape; therefore, arrangement of the controller board 120 and the sensor 130 on the metal frame may be limited. On the other hand, with the resin-made first frame 100, the pathway for the harness 131 and a supporting structure for the harness 131 may be easily formed on the first frame 100 in more flexibly designed shapes. Therefore, the range of design options for the color laser printer 1 may be widened even more broadly.

According to the color laser printer 1, the spring electrodes 230, 240 are connected with the power board 220 through the through-holes 203, 204 formed in the second frame 200. Thus, while the power board 220 is disposed on the opposite side from the processing unit 6 across the second frame 200, the connection between the power board 220 and the spring electrodes 230, 240 may be maintained in the simple configuration.

According to the color laser printer 1, the first spring part 242, along with the ring part 241, may be displaced from the second spring part 243 vertically. Therefore, a range of configuration options for the processing unit 6 and arrangement options for the power board 200 may be widened. In other words, the range of design options for the color laser printer 1 may be widened to be broader.

According to the color laser printer 1, as shown in FIG. 6, the plurality of photosensitive drums 61 are held indirectly by the first frame 100 and the second frame 200 through the holder 60. Therefore, compared to a configuration, in which the photosensitive drums are held directly by the first frame and the second frame being made of different materials with different thermal expansion rates, an influence to the photosensitive drums 61 due to the different thermal expansion rates may be restrained to be smaller.

According to the color laser printer 1, the plurality of photosensitive drums 61 are held to be spaced apart from one another at the predetermined interval by the pair of lateral plates 60B. Therefore, even when the lateral plates 60B thermally expand due to temperature changes in the environment, and when the distances between the photosensitive drums 61 change due to thermal expansion of the lateral plates 60B, the change may be substantially equalized between the lateral plate 60B on the right and the lateral plate 60B on the left. Therefore, an influence due to the change in the distances between the photosensitive drums 61 may be restrained to be smaller.

Further, according to the color laser printer 1, the pair of lateral plates 60B are made of metal, of which thermal expansion rate is relatively smaller than, for example, resin. Therefore, an amount of the change in the distances between the photosensitive drums 61 due to the temperature changes in the environment may be restrained to be smaller.

According to the color laser printer 1, the positioning holes 150A, 200A and the positioning edges 150B, 200B to locate the holder 60 and the photosensitive drums 61 in the correct positions with respect to the main body 2 are formed in the metal frame 150 and the second frame 200, which are made of metal with the smaller thermal expansion rate and the rigidity compared to, for example, resin. Therefore, the positions of the photosensitive drums 61 may be placed in the correct positions with respect to the main body 2 easily and accurately.

According to the color laser printer 1, the photosensitive drums 61 are supported by the metal frame 150 and the second frame 200 through the holder 60 while, as shown in FIG. 3, the exposure device 5 is supported by the metal frame 150 and the second frame 200 through the scanner plate 300. Therefore, the positional relation between the photosensitive drums 61 and the exposure device 5, which are supported by the metal members, may be effectively and accurately maintained.

According to the color laser printer 1, the first frame 100 and the second frame 200 are connected with each other by a plurality of connecting members, which include the scanner plate 300, the front beam 410, and the rear beam 420. Therefore, displacement between the first frame 100 and the second frame 200 may be effectively restrained.

According to the color laser printer 1, for example, as shown in FIG. 1, the scanner plate 300 and the front beam 410, the rear beam 420 are arranged to oppose to each other across the line L, which extends through the rotation axes of the photosensitive drums 61. Therefore, while the color laser printer 1 is equipped with the plurality of photosensitive drums 61, the displacement between the first frame 100 and the second frame 200 may be effectively restrained by the scanner plate 300 and the front beam 410, the rear beam 420, which oppose to each other across the photosensitive drums 61. Further, while the color laser printer 1 is equipped with the plurality of photosensitive drums 61, it may be inevitable that sizes of the first frame 100 and the second frame 200 should increase. Meanwhile, according to the color laser printer 1, the first frame 100 is made of resin; therefore, an entire weight of the color laser printer 1 may be effectively reduced.

Although an example of carrying out the invention has been described, those skilled in the art will appreciate that there are numerous variations and permutations of the color laser printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the metal-made second frame 200 may not necessarily be formed in the size to have substantial outlines, which encompass the feeder unit 3 and the processing unit 6 therein in the view along the widthwise direction (see FIG. 4), but a metal-made frame 600 (see FIG. 8) may be formed in a size to have outlines, which encompass the processing unit 6 alone therein in a view along the widthwise direction. In other words, a vertical dimension (height) of the second frame 600 may be smaller than the second frame 200 in the previous embodiment as long as the outlines of the second frame 600 encompasses the processing unit 6 in the view along the widthwise direction.

Figure 8:
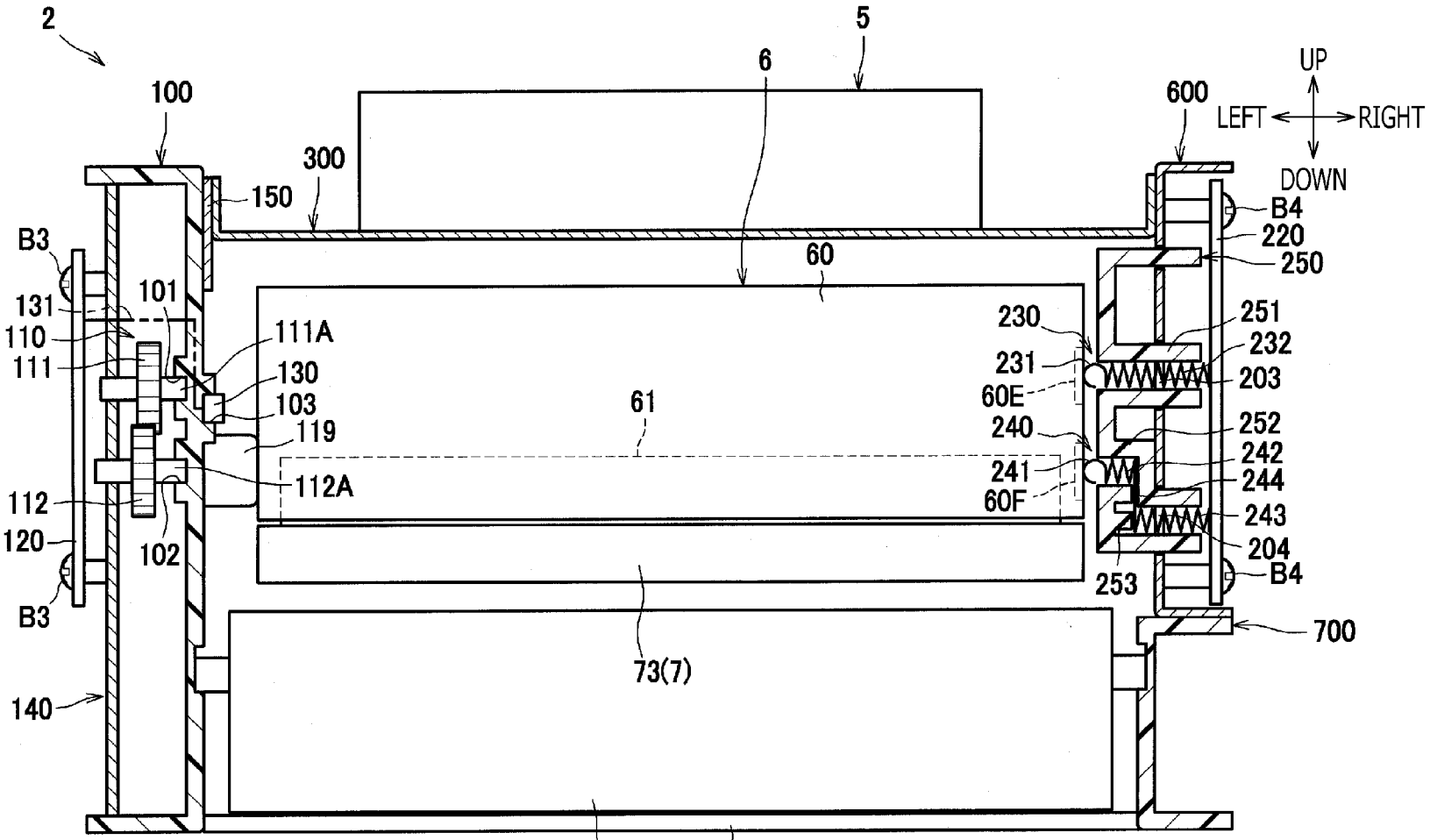
FIG. 8 is a cross-sectional view of the main body of the color laser printer.

With the second frame 600 as shown in FIG. 8, the main body 2 may be equipped with a third frame 700. The third frame 700 may be disposed in a lower position with respect to the second frame 600 to support the second frame 600 from below and may be made of resin such as ABS in molding. The second frame 600 may be fixed to an upper part of the third frame 700 by, for example, screws (not shown). The third frame 700 may support the feeder tray 31 in conjunction with the first frame 100.

According to the configuration shown in FIG. 8, the frame to be disposed on the right-hand side of the photosensitive drums 61 may be configured with the metal-made second frame 600 and the resin-made third frame 700 arranged in the lower position with respect to the second frame 600. Thereby, the weight of the color laser printer 1 may be reduced to be even lighter. Further, while the first frame 100 and the third frame 700 are made of resin, even if the color laser printer 1 is placed on an uneven surface with asperity, an influence caused by the asperity may be absorbed by deformation of the first frame 100 and the third frame 700. Therefore, distortion in the main body 2 or the processing unit 6 supported by the main body 2 may be restrained.

For another example, the resin-made first frame 100 and the metal-made second frame 200 may not necessarily be arranged on the left-hand side and the right-hand side of the photosensitive drums 61 respectively but may be inverted to be on the right-hand side and the left-hand side respectively.

For another example, the spring electrodes 230, 240 may not necessarily be in the forms described as above. For example, the parts of the spring electrodes 230, 240 to contact the holder electrodes 60E, 60F may not necessarily be in the form of the rings but may be spheres. For another example, each spring electrode 230, 240 may not necessarily be a single piece of wire but may be made with a plurality of pieces of wires or may include other members. For another example, the spring electrodes 230, 240 may not necessarily include the compressed coiled springs but may include, for example, blade springs.

For another example, the scanner plate 300 may not necessarily have the form of a spread plate but may be in a form of a beam, such as the front beam 410 or the rear beam 420. Meanwhile, the front beam 410 or the rear beam 420 may be in a form of a spread plate. For another example, a quantity of the scanner plate 300 may not necessarily be limited to one (1), but the scanner plate 300 may include a plurality of plates. Similarly, a quantity of the front and rear beams 410, 420 may not necessarily be limited to two (2). For another example, a method to connect the first frame 100 and the second frame 200 with each other may not necessarily be limited to the method described as above. For example, the scanner plate 300 (see FIG. 3) may be fixed to the frame 150 and the second frame 200 by welding.

For another example, the exposure device 5 may not necessarily be supported indirectly by the metal frame 150 through the scanner plate 300 but may be directly fixed to the metal frame 150 and the second frame 200 to be supported by the metal frame 150 and the second frame 200.

For another example, the metal frame 150 may not necessarily be configured with two pieces of metal frames, i.e., the first metal frame 151 and the second metal frame 152, but may be formed as a single piece or configured with three or more pieces of frames. For another example, the metal frame 150 may even be omitted from the color laser printer 1.

For another example, the lateral plates 60B of the holder 60 may not necessarily be made of metal but may be made of resin. For another example, the holder 60 may not necessarily include the resin-made holder frame 60A and the metal-made lateral plates 60B, but the holder 60 may be made solely of resin or solely of metal. For another example, the distances between the plurality of photosensitive drums 61 along the front-rear direction may not necessarily be fixed by the pair of lateral plates 60B, but the holder 60 may hold the photosensitive drums 61 with a certain extent of movable allowance. If the holder 60 is configured to hold the photosensitive drums 61 with the movable allowance, it may be preferable that the distances between the plurality of photosensitive drums 61 along the front-rear direction may be fixed when the holder 60 is correctly attached to the main body 2. For another example, the processing unit 6 may not be equipped with the holder 60, but the holder 60 for the processing unit 6 may be omitted.

For another example, the processing unit 6 may not necessarily be equipped with the plurality of photosensitive drums 61 but may be equipped with a single photosensitive drum. In other words, the embodiment described above may not necessarily be applied to a color laser printer but may be employed in, for example, a monochrome printer equipped with a single photosensitive drum. For another example, the photosensitive drum may be replaced with a photosensitive belt, an intermediate transfer drum, or an intermediate transfer belt.

For another example, the color laser printer 1 may not necessarily be configured to expose the photosensitive drums 61 to the laser beams emitted from the exposure device 5 but may be configured to expose the photosensitive drums 61 by light emitted from light emitting diodes (LEDs). For another example, the embodiment described above may not necessarily be applied to the color printer but may be applied to a copier or a multifunction peripheral device which includes an image reading device such as a flatbed scanner.

What is claimed is:

1. An image forming apparatus, comprising:

a main body configured to support an image forming unit, the image forming unit comprising an image carrier; and a driving force transmission configured to transmit a driving force to the image carrier;

wherein the main body comprises a first frame, the first frame being made of resin and being disposed on one side of the image carrier with respect to a direction of rotation axis of the image carrier, the first frame being configured to support the driving force transmission disposed thereon, a second frame, the second frame being made of metal and being disposed on the other side of the image carrier with respect to the direction of rotation axis, and a connecting member configured to connect the first frame and the second frame with each other, wherein the first frame and the second frame are arranged so that inward surfaces of the first and second frames face each other.

2. The image forming apparatus according to claim 1, further comprising:

a power board configured to supply electricity to the image forming unit; and a spring electrode disposed in a position between the image forming unit and the power board in a compressed condition, wherein the power board is disposed on the second frame.

3. The image forming apparatus according to claim 2, wherein the power board is disposed on an opposite side from the image forming unit across the second frame;

wherein the second frame comprises a through-hole bored through the second frame along the direction of rotation axis; and wherein the spring electrode is disposed to penetrate through the through-hole to be connected to the power board.

4. The image forming apparatus according to claim 2, wherein the power board is disposed on an opposite side from the image forming unit across the second frame;

wherein the spring electrode comprises a spring part, the spring part being disposed in a position between the image forming unit and the second frame in a compressed condition; a board-side connecting part, at which the spring electrode is connected with the power board; and a conducting part, the conducting part being conductive between the board-side connecting part and the spring part; and wherein the spring part and the board-side connecting part are arranged in positions displaced from each other in a view along the direction of rotation axis.

5. The image forming apparatus according to claim 1, wherein the first frame comprises a sensor support, the sensor support being configured to support a sensor for controlling the image forming apparatus.

6. The image forming apparatus according to claim 5, further comprising:

a controller board configured to control the image forming apparatus, wherein the controller board is disposed on the first frame and is connected with the sensor.

7. The image forming apparatus according to claim 1, wherein the driving force transmission comprises a gear; and wherein the first frame comprises a gear support configured to support the gear rotatably.

8. The image forming apparatus according to claim 1, further comprising:

a sheet container disposed in a lower position with respect to the image forming unit and configured to contain a recording sheet to be fed to the image forming unit; and a third frame made of resin and configured to support the sheet container, the third frame being disposed in a lower position with respect to the second frame and configured to support the second frame from below.

9. The image forming apparatus according to claim 1, wherein the connecting member comprises a first connecting member and a second connecting member, the second connecting member being arranged to locate the image carrier in an intervening position between the first connecting member and the second connecting member in a view along the direction of rotation axis.

10. The image forming apparatus according to claim 9, wherein the image carrier comprises a plurality of photosensitive drums arranged to align along a predetermined aligning direction; and wherein the first connecting member and the second connecting member are arranged in opposite positions from each other across a line extending through rotation axes of the plurality of photosensitive drums.

11. The image forming apparatus according to claim 1, wherein the image carrier comprises a plurality of photosensitive drums arranged along a predetermined aligning direction;

wherein the image forming unit comprises a holder, the holder being configured to hold the plurality of photosensitive drums and being movable with respect to the main body along the predetermined aligning direction; and wherein the plurality of photosensitive drums are supported by the first frame and the second frame through the holder.

12. The image forming apparatus according to claim 11, wherein the holder comprises a pair of plates arranged on each side of the plurality of photosensitive drums with regard to a direction of rotation axes of the plurality of photosensitive drums, the pair of plates being configured to hold the plurality of photosensitive drums to be spaced apart from one another at an interval along the aligning direction.

13. The image forming apparatus according to claim 12, wherein the pair of plates are made of metal.

14. The image forming apparatus according to claim 11, further comprising:

a fourth frame made of metal, the fourth frame being fixed to the first frame on a side of the plurality of photosensitive drums with regard to the direction of rotation axes of the plurality of photosensitive drums;

wherein each of the second frame and the fourth frame comprises a positioning part configured to define a position of the holder with respect to the main body.

15. The image forming apparatus according to claim 14, further comprising:

an exposure device configured to expose the plurality of photosensitive drums to light, wherein the exposure device is supported by the second frame and the fourth frame.

16. The image forming apparatus according to claim 1, further comprising a feeder unit, wherein the first and second frames are formed in sizes having substantial outlines which encompass the feeder unit and the image forming unit therein in a view along the direction of the rotation axis.

* * * * *